US006539761B2

(12) United States Patent
Yang

(10) Patent No.: US 6,539,761 B2
(45) Date of Patent: Apr. 1, 2003

(54) PADLOCK BY COMBINING KEY-OPERATED LOCK AND COMBINATION LOCK

(76) Inventor: Kuo-Tsung Yang, 1F1., No. 9, Alley 10, Lane 321, Hsin-Ming Road, Nei-Fu District, Taipei (TW)

( * ) Notice: Subject to any disclaimer, the term of this patent is extended or adjusted under 35 U.S.C. 154(b) by 0 days.

(21) Appl. No.: 09/897,650

(22) Filed: Jun. 28, 2001

(65) Prior Publication Data

US 2003/0000264 A1 Jan. 2, 2003

(51) Int. Cl.[7] ..... E05B 37/00

(52) U.S. Cl. ..... 70/284; 70/285; 70/38 C; 70/21; 70/26; 70/28

(58) Field of Search ..... 70/284, 285, 38 C, 70/25, 26, 27, 28, 21

(56) References Cited

U.S. PATENT DOCUMENTS

| | | | | | |
|---|---|---|---|---|---|
| 972,171 | A | * | 10/1910 | Dupont | 70/21 |
| 2,163,852 | A | * | 6/1939 | Pond | 70/21 |
| 2,931,203 | A | * | 4/1960 | Check | 70/21 |
| 2,931,204 | A | * | 4/1960 | Check | 70/21 |
| 3,448,598 | A | * | 6/1969 | Niilola | 70/1.5 |
| 3,750,431 | A | * | 8/1973 | Atkinson | 70/21 |
| 3,823,584 | A | * | 7/1974 | Gill | 70/21 |
| 4,325,240 | A | * | 4/1982 | Gable | 70/284 |
| 4,341,099 | A | * | 7/1982 | Garro | 70/25 |
| 4,730,467 | A | * | 3/1988 | Lebrecht | 70/21 |
| 5,953,940 | A | * | 9/1999 | Ling | 70/20 |

* cited by examiner

*Primary Examiner*—Lloyd A. Gall
*Assistant Examiner*—Michael J. Kyle

(57) ABSTRACT

A padlock includes: a lock body; a shackle operatively locked in or unlocked from the lock body; a key-operated locking device formed in the lock body for operatively unlocking the shackle for unlocking the padlock by using a key, and a combination locking device juxtapositionally formed in the lock body for operatively unlocking the shackle for unlocking the padlock merely by dialing the combination to an unlocking number.

6 Claims, 3 Drawing Sheets

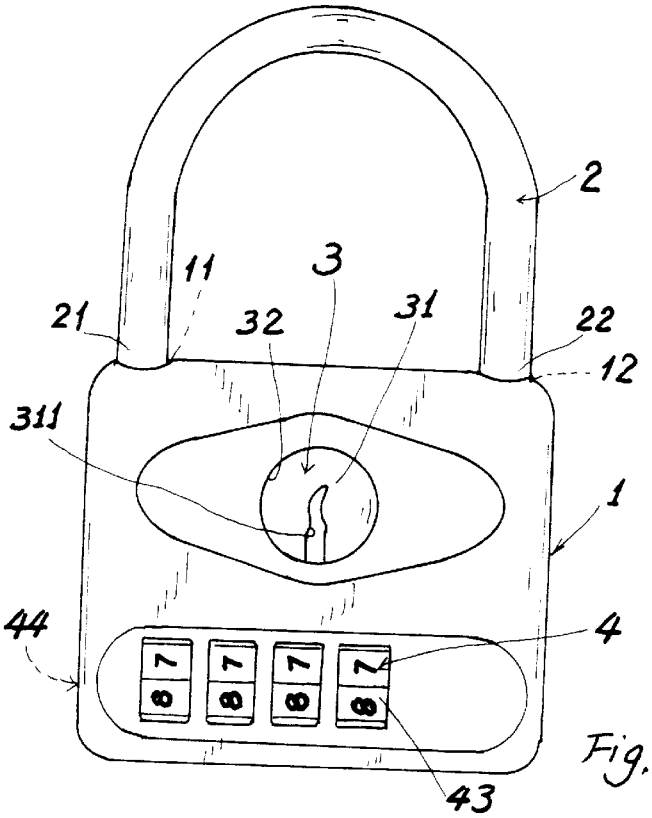
Fig. 1
Fig. 2
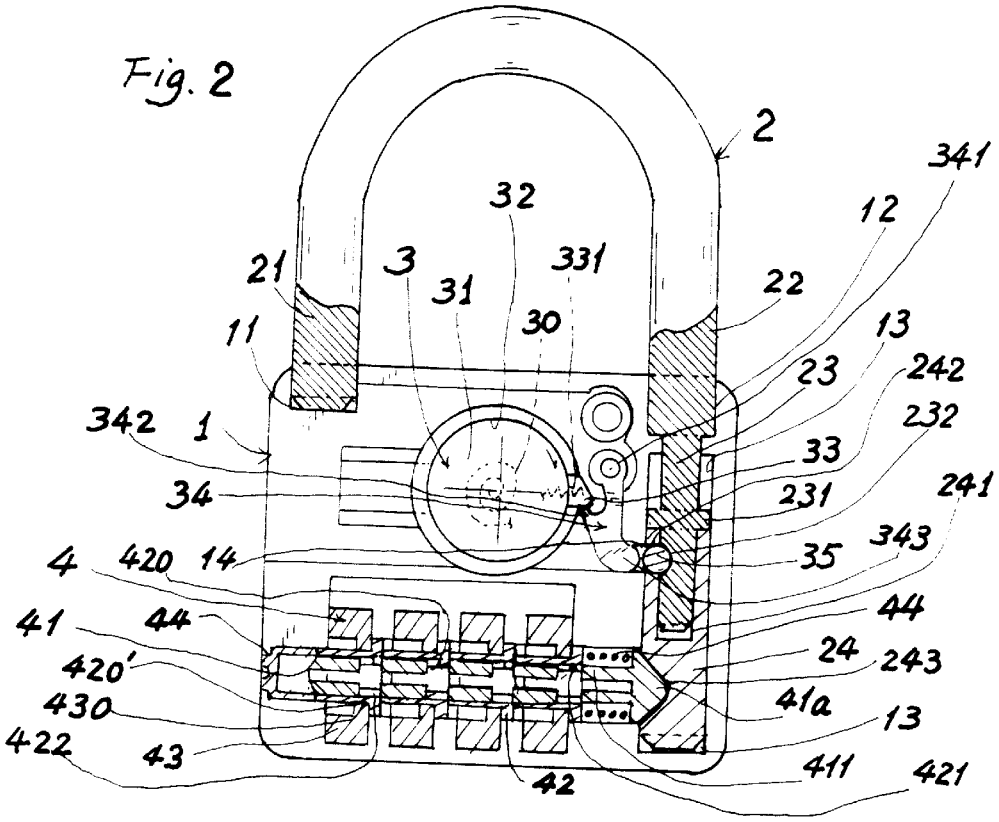

PADLOCK BY COMBINING KEY-OPERATED LOCK AND COMBINATION LOCK

BACKGROUND OF THE INVENTION

A conventional padlock, if provided with a key-operated locking mechanism therein, should be unlocked by a key. For someone, he or she does not like to carry a key or may lose the key easily, he or she would prefer to use a combination padlock rather than a key-operated padlock.

Comparatively, someone may dislike to use the combination lock due to poor vision to watch a small combination as shown on the combination lock and he or she may then prefer to use the key-operated padlock.

However, there is no padlock ever disclosed to provide the double-function padlock both for a key-operated lock and a combination lock.

SUMMARY OF THE INVENTION

The object of the present invention is to provide a padlock including: a lock body; a shackle operatively locked in or unlocked from the lock body; a key-operated locking device formed in the lock body for operatively unlocking the shackle for unlocking the padlock by using a key, and a combination locking device juxtapositionally formed in the lock body for operatively unlocking the shackle for unlocking the padlock merely by dialing the combination to an unlocking number.

BRIEF DESCRIPTION OF THE DRAWINGS

FIG. 1 is an illustration showing the padlock of the present invention.

FIG. 2 is a sectional drawing showing the present invention as locked.

DETAILED DESCRIPTION

Figure 3:
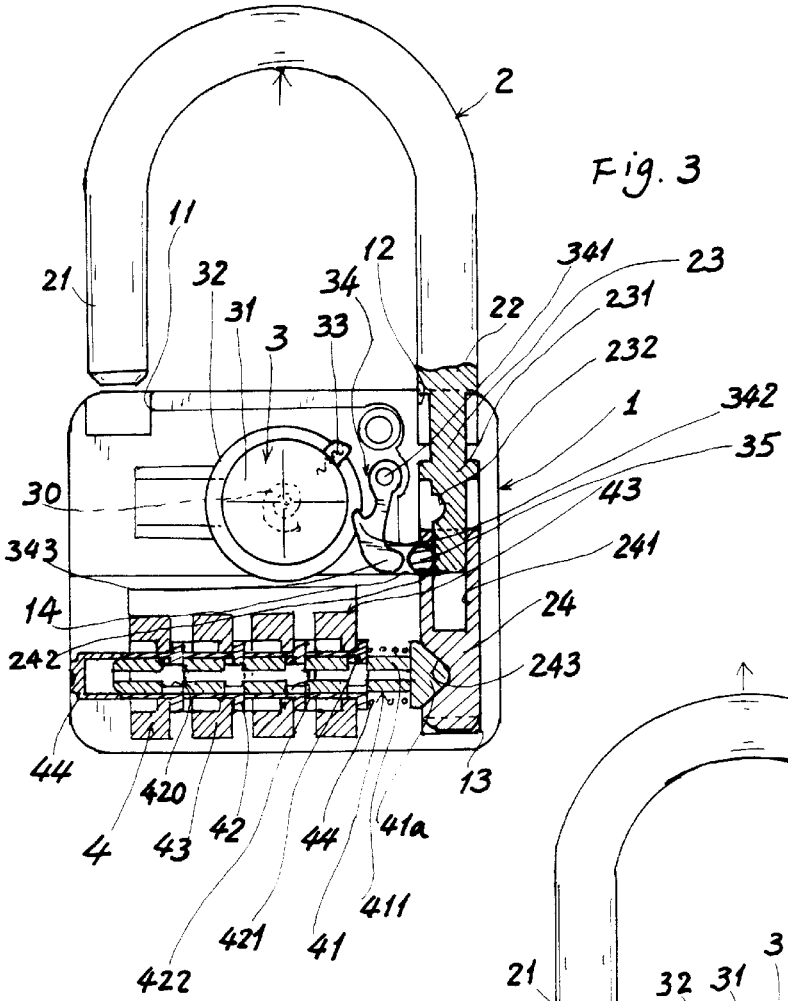
FIG. 3 shows an unlocked state of the present invention by operating the key-operated locking means.

As shown in the drawing figures, the present invention comprises: a lock body 1, a shackle 2 of U shape operatively locked in or unlocked from the lock body 1; a key-operated locking means 3 formed in the lock body 1; and a combination locking means 4 juxtapositionally formed in the lock body 1.

The shackle 2 is generally formed as a U shape and includes: a short rod 21 lockable in a first rod hole 11 formed in the lock body, and a long rod 22 lockable in a second rod hole 12 formed in the lock body 1. The long rod 22 is downwardly protruded to form a core rod 23 slidably engageable with a sleeve rod 24 which is slidably held in a sleeve hole 13 vertically formed in the lock body and communicated with the second rod hole 12.

The lock body 1 may be formed by two half shells (not shown) combinable for forming the lock body.

The key-operated locking means 3 includes: a locking core 31 rotatably mounted in a cylinder 32 formed in the lock body 1, a locking tongue 33 connected to the locking core 31 and resiliently protruding outwardly adapted for locking the shackle 2, a control member 34 which may be formed as a biasing member formed in the lock body 1 and a locking ball 35 operatively engaging the core rod 23 of the shackle 2.

The core rod 23 of the shackle 2 is formed with a flange 231 circumferentially formed on the core rod 23 and upwardly limited by an upper end of the sleeve hole 13 and downwardly retarded against an upper end of the sleeve rod 24, and an arcuate recess 232 recessed in the core rod 23 for engaging the locking ball 35 when locked as shown in FIG. 2. The core rod 23 is slidably engageable with the core-rod hole 241 longitudinally formed in the sleeve rod 24; while the locking ball 35 may be slid along a side ball hole 242 transversely formed in the sleeve rod 24 when unlocking the padlock.

The sleeve rod 24, as slidably held in the sleeve hole 13, is formed with a V-shape or arcuate shape recess 243 for engaging the locking head 41*a* of the locking bolt 41 of the combination locking means 4 as shown in FIG. 2.

For locking the key-operated locking means 3 of the present invention as shown in FIG. 2, the shackle 2 is downwardly depressed to engage the short rod 21 with the first rod hole 11 in the lock body, a restoring spring 30 formed in the locking core 31 resiliently restoring the locking tongue 33 clockwise for forcibly urging a depression portion 342 formed on the biasing member (or control member) 34 pivotally mounted in the lock body 1 by a pivot 341; and an end hook portion 343 formed on a bottom end portion of the biasing member 34 for blocking or limiting the locking ball 35 within the ball hole 242 transversely formed in the sleeve rod 24 and allowing the locking ball 35 to be engaged with the arcuate recess 232 in the core rod 23.

Upon an upward pulling of the shackle 2 by an intruder trying to allow the arcuate recess 232 in the core rod 23 to thrust the ball 35 leftwardly (into slot 14 in lock body) for unlocking the rod 23 and the shackle 2. However, the end hook portion 343 of the biasing member 34 will not be retracted leftwardly (FIG. 2) as the depression portion 342 of the biasing member 34 is locked against the locking tongue 33 which is now placed at locking state, thereby locking the present invention.

Meanwhile, the V-shaped recess 243 of the sleeve rod 24 is engaged by the locking head 41a of the locking bolt 41 of the combination locking means 4, also ensuring the present invention to be placed at a real locking state as shown in FIG. 2.

For unlocking the present invention from FIG. 2 to FIG. 3, a key is inserted into a key hole 311 formed in the locking core 31 to rotate the locking tongue 33 counter-clockwise; and upon an upward pulling of the shackle 2 and the rods 22, 23, the arcuate recess 232 will thrust the ball 35 leftwardly since the end hook portion 343 of the biasing member 34 no longer retarding the ball 35, thereby unlocking the ball 35 and allowing an upward pulling of the core rod 23 (FIG. 3) for unlocking the key-operated locking means 3 and the padlock of the present invention. The sleeve rod 24 has its recess 243 still engaged and locked by the locking head 41*a* (FIG. 3).

When withdrawing the key from the key hole of the locking core 31, the locking core 31 as restored by the spring 30 will be restored and rotated clockwise to allow the locking tongue 33 to depress the depression portion 342 of the biasing member 34 in a tendency to bias the end hook portion 343 rightwardly to thrust (re-locate) the ball 35 to be engaged with the recess 232 of the core rod 23 when further depressing the shackle 2 and the rod 23 downwardly or re-locking the padlock of the present invention (FIG. 2).

Besides the locking mechanism of the key-operated locking means as aforementioned and illustrated in FIGS. 2, 3, other modifications or other key-operated mechanisms may be applied in this invention, not limited by the present invention.

The combination locking means 4 includes: a locking bolt 41 held in the lock body 1 and having a V-shaped (or arcuate shape) locking head 41*a* formed on an end portion of the bolt 41 to be engaged with the V-shaped recess 243 as recessed in the sleeve rod 24 of the shackle 2; a plurality of sleeves 42 and dials 43 with each sleeve 42 engaging with each dial 43 at the annular portion 420', 430 of each sleeve 42 and each dial 43 and rotatably disposed about the locking bolt 41; and a tension spring 44 resiliently retained between the sleeves 42 and the locking head 41*a* for normally urging the locking head 41*a* to be engaged with the V-shaped recess 243 of the sleeve rod 24 for locking the shackle 2 in the lock body 1 (FIG. 2).

Each sleeve 42 includes: a central hole 420 rotatably engageable with the locking bolt 41, a retaining ring 421 annularly formed in the sleeve 42 for retarding at least a projection 411 formed on the locking bolt for locking the bolt 41 and the shackle 2 of the present invention at a locking state (FIG. 2), and at least a slot 422 longitudinally formed in the retaining ring 421 for passing (retracting) the projection 411 of the locking bolt 41 when unlocking the combination locking means 4 of the present invention (FIG. 4) by upwardly pulling the shackle 2; whereby upon unlocking, the bolt 41 is retractable leftwardly to allow the V-shaped recess 243 of the sleeve rod 24 to thrust the V-shaped locking head 41*a* of the locking bolt 41 leftwardly, the locking head 41*a* of the bolt 41 is thereby unlocked for allowing the upward pulling of the rod 24 and the shackle 2 for unlocking the present invention.

Figure 4:
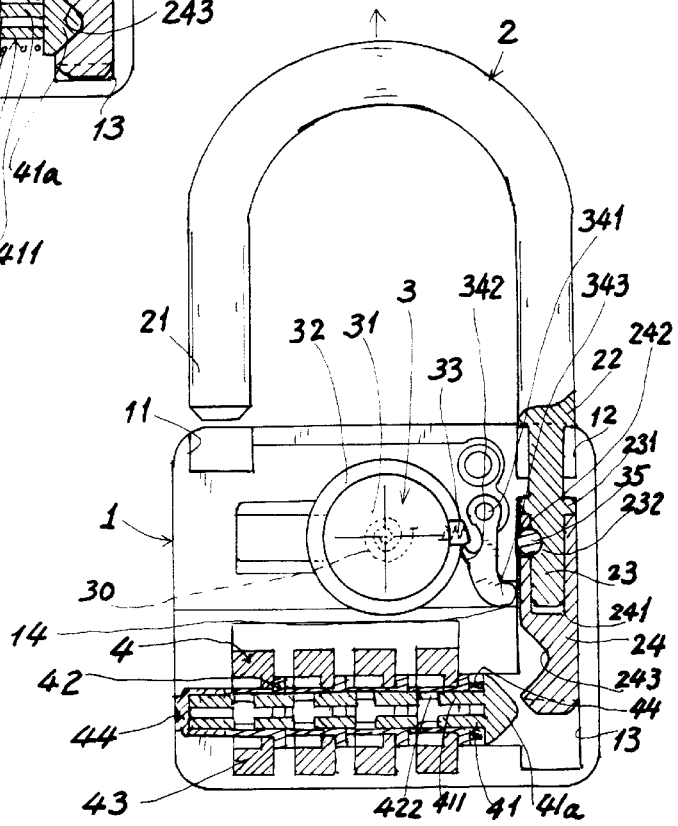
FIG. 4 shows the unlocked state by operating the combination locking means.

When unlocking the combination locking means 4 from a locking state of the present invention by upwardly pulling the shackle 2, the key-operated locking means 3 should be kept at a locking state to allow the end hook portion 343 of the biasing member 34 to retard (limit) the ball 35 without disengagement of the ball 35 from the recess 232 in the core rod 23. Accordingly, when unlocking the combination locking means 4, the core rod 23 as coupled with the sleeve rod 24 will be simultaneously pulled upwardly for unlocking the shackle 2 (FIG. 4).

For locking the combination locking means 4, the shackle 2 is then downwardly depressed to allow the recess 243 of the rod 24 to be re-engaged with the locking head 41 a of the bolt 41 as restored by the spring 44 (FIG. 2). The combination should then be dialed to a locking state.

Figure 5:
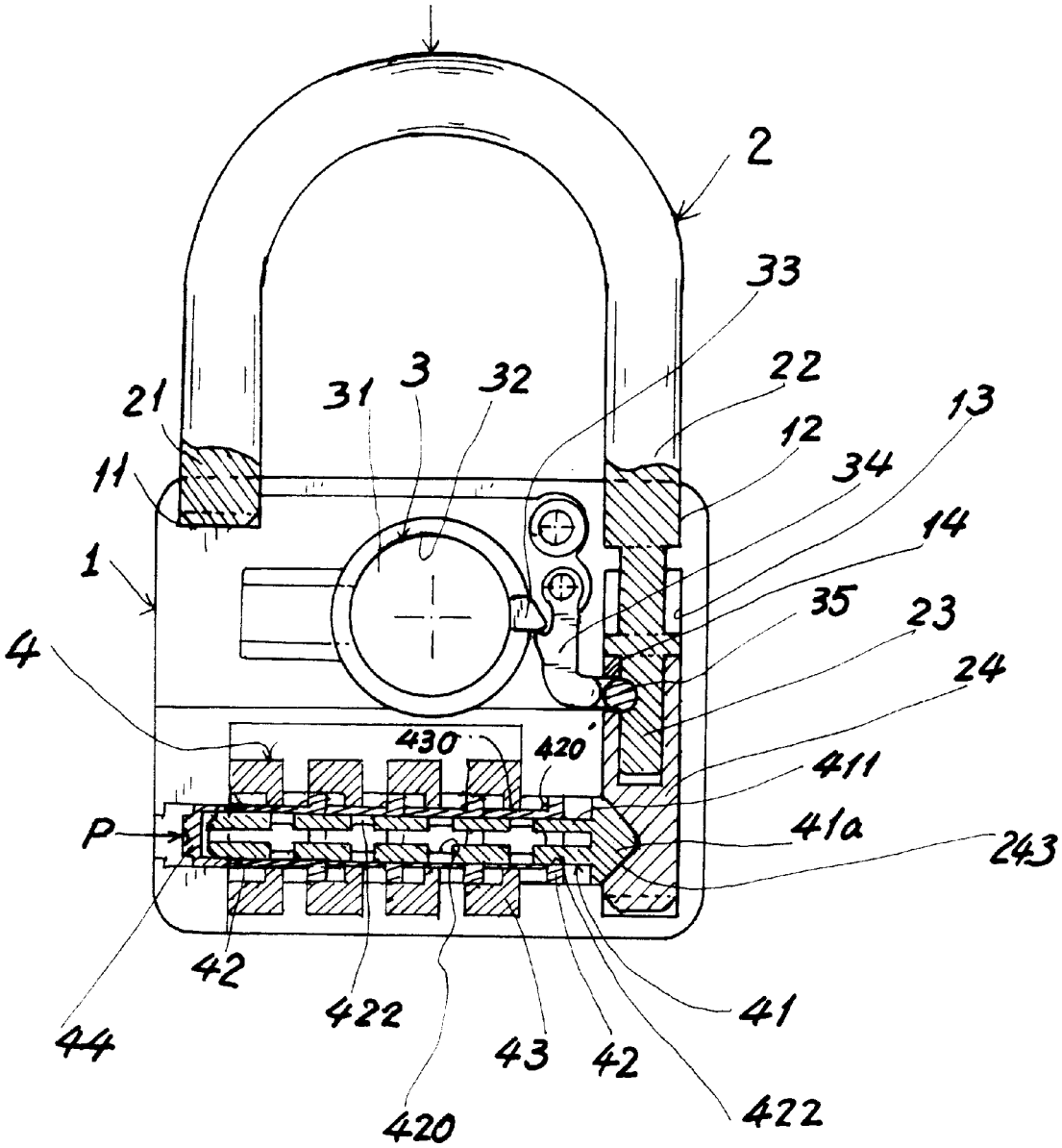
FIG. 5 is an illustration showing the change of the combination of the present invention.

As shown in FIG. 5, the combination locking means 4 further includes a combination changing device 44 which is substantially an end sleeve 44 slidably held in a side portion (for example, a left side portion) of the lock body 1 opposite to the locking head 41*a* of the locking bolt 41 to be circumferentially contacted with the sleeve 42, whereby upon unlocking of the combination locking means 4 to engage the projection 411 on the locking bolt 41 with the slot 422 in the sleeve 42 and upon an inward pushing (P) as shown in FIG. 5 to disengage the sleeves 42 from the dials, 43, the dials 43 will then be free rotated for re-setting a new combination. At this time, the shackle 2 should be downwardly depressed to allow the recess 243 to be engaged with the locking head 41*a* of the bolt 41 and to engage the projection 411 of the bolt 41 with the slot 422 of the sleeve 42 to lock the sleeves 42 to prevent "free rotation" of the sleeves when free rotating the dials 43.

The present invention has double duties to satisfy both the users of key-operated locks and the users of combination locks for a very convenient locking and unlocking operation either by using a key or by dialing a combination of the padlock.

After locking the padlock of the present invention, a further safety check may be done such as by further trying to pull the shackle 2 upwardly. If the shackle 2 can not be pulled upwardly (to lift the rods 21, 22 from the corresponding rod holes 11, 12), it indicates the padlock is really locked. However, when locking the key-operated locking means 3, the combination locking means 4 is forgotten to be locked by a "former user" of the combination locking means. The shackle 2 will still be pulled upwardly as shown in FIG. 4 to lose the locking effect of the present invention. By the way, the shackle 2 should be further depressed downwardly and the dials are rotated to a locking state, thereby finally locking this padlock.

The present invention may be modified without departing from the spirit and scope of the present invention, such as by further modifying or changing the combination locking mechanism as illustrated in the drawings of this application.

I claim:

1. A padlock comprising:

a lock body;

a shackle operatively locking in or unlocking from said lock body;

a key-operated locking means formed in said lock body for unlocking said shackle from said lock body by a key for unlocking the padlock; and a combination locking means juxtapositionally formed in said lock body for unlocking said shackle from said lock body by dialing an unlocking combination of said combination locking means;

said shackle, generally U shaped, including a short rod engaging with a first rod hole in said lock body; a long rod engaging with a second rod hole in said lock body; said long rod having a core rod protruding downwardly from said long rod and slidably engaging a sleeve rod which is slidably held in a sleeve rod hole formed in said lock body positioned under and communicated with said second rod hole.

2. A padlock according to claim 1, wherein said core rod includes a flange circumferentially formed on said core rod for limiting an upward and downward movement of said core rod in the sleeve rod hole in said lock body; an arcuate recess recessed in said core rod to engage a locking ball of said key-operated locking means; with said core rod slidably engaging a core-rod hole longitudinally formed in said sleeve rod.

3. A padlock according to claim 2, wherein said key-operated locking means includes: a locking core rotatably mounted in a cylinder formed in the lock body, a locking tongue connected to the locking core and resiliently protruding outwardly adapted for locking the shackle, a control member formed in the lock body and said locking ball operatively engaging the core rod of the shackle when locking said padlock; and said locking ball operatively slid along a side ball hole transversely formed in the sleeve rod when unlocking the padlock.

4. A padlock according to claim 3, wherein said control member is a biasing member which includes a pivot for pivotally mounting said biasing member in said lock body; a depression portion formed on said biasing member to be depressed by said locking tongue of said key-operated locking means; and an end hook portion formed on a bottom end of said biasing member for retarding and locking said locking ball when said depression portion is depressed by said locking tongue when locking said padlock.

5. A padlock according to claim 1, wherein said combination locking means includes: a locking bolt held in the lock body and having a V-shaped locking head formed on an end portion of the locking bolt to be engaged with a V-shaped recess as recessed in said sleeve rod of the shackle; a plurality of sleeves and dials with each said sleeve engaging with each said dial and rotatably disposed about the locking bolt; and a tension spring resiliently retained between the sleeves and the locking head for normally urging the locking head to be engaged with the V-shaped recess of the sleeve rod for locking the shackle in the lock body; each said sleeve including: a central hole rotatably engageable with the locking bolt, a retaining ring annularly formed in each of the sleeves for retarding at least a projection formed on the locking bolt for locking the locking bolt and the shackle, and at least a slot longitudinally formed in the retaining ring for retracting the projection of the locking bolt when unlocking the combination locking means by upwardly pulling the shackle.

6. A padlock according to claim 5, wherein said combination locking means further includes a combination changing device which is formed as an end sleeve slidably held in a side portion of the lock body opposite to a locking head of the locking bolt to be circumferentially contacted with one of the sleeves, whereby upon unlocking of the combination locking means to engage the projection on the locking bolt with the slot in the sleeve and upon an inward pushing to disengage the sleeves from the dials, the dials will be free rotated for re-setting a new combination.

* * * * *